US010178912B2

(12) United States Patent
Carrera

(10) Patent No.: US 10,178,912 B2
(45) Date of Patent: Jan. 15, 2019

(54) SEAT ARRANGEMENT

(71) Applicant: CIAR S.P.A., Pesaro (IT)

(72) Inventor: Massimo Carrera, Tavullia (IT)

(73) Assignee: CIAR S.P.A., Pesaro (IT)

( * ) Notice: Subject to any disclaimer, the term of this patent is extended or adjusted under 35 U.S.C. 154(b) by 17 days.

(21) Appl. No.: 15/670,288

(22) Filed: Aug. 7, 2017

(65) Prior Publication Data

US 2018/0035803 A1 Feb. 8, 2018

(30) Foreign Application Priority Data

Aug. 8, 2016 (DE) ..... 20 2016 104 352 U

(51) Int. Cl.

| | |
|---|---|
| ***A47C 1/034*** | (2006.01) |
| ***A47C 1/0355*** | (2013.01) |
| ***A47C 7/50*** | (2006.01) |
| ***A47C 1/024*** | (2006.01) |

(52) U.S. Cl.

CPC ..... *A47C 1/0342* (2013.01); *A47C 1/024* (2013.01); *A47C 1/0355* (2013.01); *A47C 7/506* (2013.01)

(58) Field of Classification Search

CPC ..... A47C 1/0342; A47C 1/0347; A47C 1/035; A47C 1/0352; A47C 1/0355

See application file for complete search history.

(56) References Cited

U.S. PATENT DOCUMENTS

| | | | | | |
|---|---|---|---|---|---|
| 3,958,827 | A * | 5/1976 | Re | A47C 1/037 | 297/61 |
| 4,185,870 | A * | 1/1980 | Johnson | A47C 1/035 | 297/322 |
| 4,195,878 | A * | 4/1980 | Cycowicz | A47C 1/0355 | 297/318 |
| 4,212,495 | A * | 7/1980 | Gall | A47C 1/0352 | 297/259.2 |
| 4,216,991 | A * | 8/1980 | Holobaugh | A47C 1/0352 | 297/322 |

(Continued)

FOREIGN PATENT DOCUMENTS

| | | | | |
|---|---|---|---|---|
| CA | 2912194 | A1 * | 11/2014 | A47C 1/0345 |
| CA | 2992285 | A1 * | 1/2017 | A47C 1/0355 |

(Continued)

*Primary Examiner* — Timothy J Brindley

(74) *Attorney, Agent, or Firm* — Renner Kenner Greive Bobak Taylor & Weber

(57) ABSTRACT

A seat includes a base frame, seat frame, and footrest, the seat frame retained on a sliding member and pivotable about a first axis. The sliding member is displaceably guided between first and second positions in a guiding profile. The footrest is articulated to the seat frame by a rod mechanism to be adjusted between a folded-in and folded-out position. A drive for displacing the sliding member and adjusting the footrest is provided between the base frame and rod mechanism. A dual-arm lever arm having a first end, second end, and central region is rotatably supported on the sliding member in the central region and is connected with the first end to the rod mechanism and the second end to the seat frame. Movement of the footrest between the folded-in and folded-out position causes a pivot movement of the seat frame about the first axis between basic and inclined positions.

14 Claims, 19 Drawing Sheets

(56) References Cited

U.S. PATENT DOCUMENTS

| | | | | |
|---|---|---|---|---|
| 4,904,019 | A * | 2/1990 | May | A47C 1/0355 297/68 |
| 7,722,114 | B2 | 5/2010 | Smith | |
| 2009/0256402 | A1* | 10/2009 | Smith | A47C 1/0352 297/69 |
| 2015/0054315 | A1 | 2/2015 | Donovan et al. | |
| 2016/0061148 | A1 | 3/2016 | Nelson et al. | |
| 2016/0302573 | A1* | 10/2016 | Garland | A47C 1/036 |

FOREIGN PATENT DOCUMENTS

| | | | | |
|---|---|---|---|---|
| DE | 2717331 | A1 | 11/1977 | |
| DE | 102005044342 | A1 * | 3/2007 | A47C 1/0355 |
| DE | 212015000038 | U1 | 7/2016 | |

* cited by examiner

SEAT ARRANGEMENT

TECHNICAL FIELD

The invention relates to a seat arrangement having a base frame, a seat member and a footrest.

BACKGROUND

U.S. Pat. No. 7,722,114 B2 discloses a recliner chair which can be adjusted from an upright position of the seat and backrest into a reclined position with a folded-out footrest and inclined backrest. To this end, the rear end of the seat and the lower end of the backrest are supported on a movable sliding member, wherein the sliding member can be moved from a rear position into a front position and in this instance the front end of the seat is raised and the angle between the seat and backrest is increased. At the same time, the footrest is folded out by means of a rod mechanism.

SUMMARY

An object of the invention is to produce a seat arrangement with a displaceable seat member and a footrest which can be folded in and out and which has a compact mechanism.

This object is achieved according to the invention by the features of claim 1.

The seat arrangement according to the invention has a base frame, a seat member and a footrest, wherein the seat member provides for a seat frame which is retained on a sliding member so as to be able to be pivoted about a first articulation axis, wherein the sliding member is displaceably guided between a first and a second position in a guiding profile, and wherein the footrest is articulated to the seat frame by means of a rod mechanism and can be adjusted between a folded-in position and a folded-out position. Furthermore, a drive for displacing the sliding member and for folding the footrest in and out is provided between the base frame and the rod mechanism of the footrest. Furthermore, the seat arrangement comprises a dual-arm lever arm having a first end, a second end and a central region, wherein the dual-arm lever arm is rotatably supported on the sliding member in the central region thereof and is connected with the first end thereof to the rod mechanism of the footrest and with the second end thereof to the seat frame in such a manner that a movement of the footrest between the folded-in and folded-out position brings about a pivot movement of the seat frame about the first articulation axis between a basic position and an inclined position.

As a result of the dual-arm lever arm which is rotatably supported on the sliding member, it is possible to produce a relatively compact mechanism which in comparison with conventional mechanisms requires less structural space.

The dependent claims relate to other embodiments of the invention.

According to an embodiment of the invention, it is possible to change only the seat depth by displacing the sliding member without folding out the footrest in this instance.

According to a first embodiment of the invention, the dual-arm lever arm is rotatably supported on the sliding member by means of a second articulation, wherein the first articulation is guided in a slot which is formed in the sliding member. In this manner, it is possible, on the one hand, for the seat frame to be able to be pivoted about the first articulation axis by the front end of the seat member being raised or lowered and, on the other hand, for the footrest to be able to be folded in and out.

According to a second embodiment of the invention, the connection of the dual-arm lever arm to the seat frame is carried out by means of a bearing, in particular a plain bearing or a roller bearing.

According to a third embodiment, the connection of the dual-arm lever arm to the seat frame can also be produced by means of a second articulation which is guided in a slot formed in the seat frame.

In all three production variants, a relative movement in the region of the connection of the lever arm to the sliding member or the seat frame is consequently possible in order to thereby enable the pivot movement of the seat frame about the first articulation axis.

The first articulation axis may in this instance in particular be arranged at a rear end of the seat frame whilst the rod mechanism of the footrest is coupled to a front end of the seat frame. Furthermore, between the base frame and the sliding member there may be provided at least a first resilient element which urges the sliding member into the second position in which the seat has a greater seat depth than in the first position. Furthermore, between the sliding member and the seat frame there may be provided at least a second resilient element which urges the seat frame into the basic position.

The base frame of the seat arrangement which is intended to be understood to be a stationary frame has a first transverse rod. If the drive is formed by a linear actuator, it can be coupled with one end to the first transverse rod of the stationary base frame and with the other end thereof to a second transverse rod of the rod mechanism of the footrest. In this manner, both a displacement of the seat member and folding in and out of the footrest can be carried out by means of a single drive. In this instance, it is in particular conceivable for the displacement of the seat member to be carried out initially and for the folding-out of the footrest to begin only afterwards.

The displacement of the seat member can be carried out in such a manner that the seat member in the second position of the sliding member has a seat depth which is at least 10% greater than in the first position of the sliding member. Furthermore, it is advantageous for the seat frame to be pivoted between the basic position and the inclined position through at least 5° about the first articulation axis.

According to another embodiment of the invention, the guiding profile, the sliding member, the seat frame and the rod mechanism for the footrest can be combined to form a base module which is displaceably guided in the base frame. Furthermore, a backrest may be provided, wherein the adjustment of the inclination of the backrest is carried out by means of a backrest inclination module. The backrest inclination module may in this instance comprise a coupling rod assembly which is secured with one portion to the base module and with another portion to the base frame.

Finally, there may also be provided a zero space module which has an actuation rod assembly which is secured with one portion to the base frame and with another portion to the base module. The zero space module is distinguished in that the mechanical system thereof is constructed in such a manner that the seat arrangement can be placed with a small spacing from a wall and can be moved from the upright position into a horizontal reclined position without the backrest coming into contact with the wall. This is achieved in that, when the backrest is inclined backwards, the seat is at the same time displaced forwards.

As a result of the coupling of the base module, backrest inclination module and zero space module as set out above, an adjustment of the seat arrangement from an upright position into a horizontal reclined position is possible using a single drive. In this instance, it is also possible to assume an intermediate position in which only the seat depth is increased, wherein the footrest is still folded in.

BRIEF DESCRIPTION OF THE DRAWINGS

More detailed embodiments and advantages of the invention will be explained in greater detail with reference to the following description of some embodiments and the drawings, in which.

DETAILED DESCRIPTION OF ILLUSTRATIVE EMBODIMENTS

Figure 1:
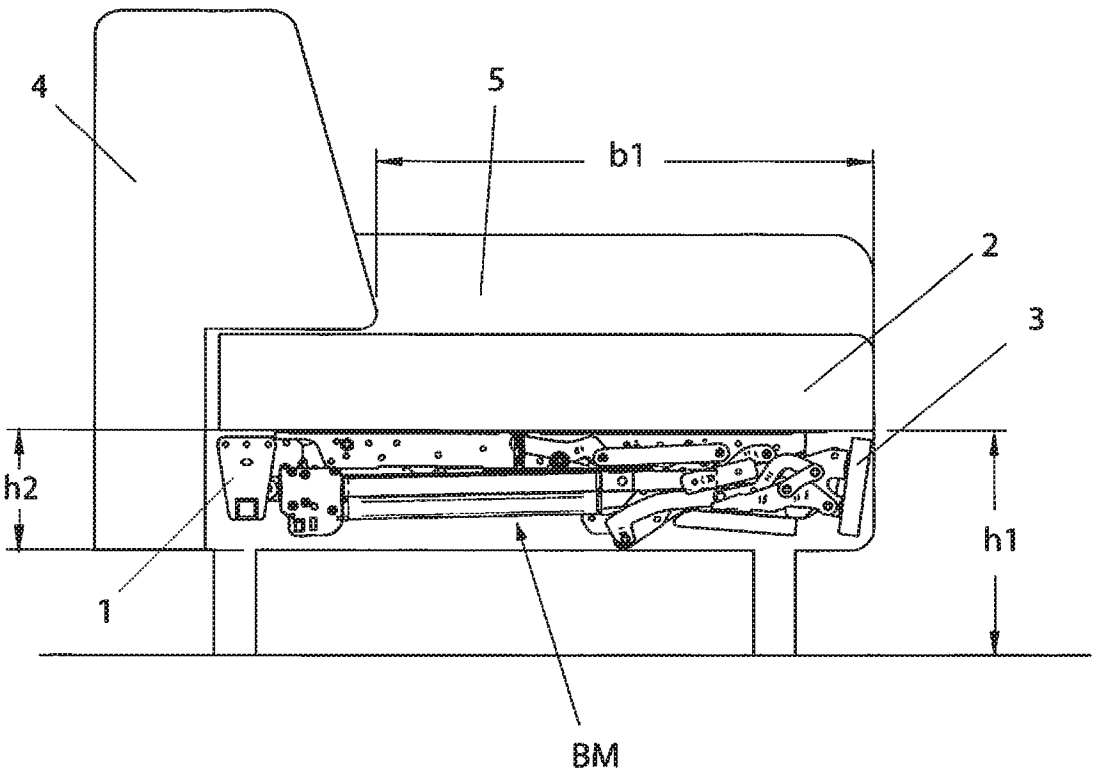
FIG. 1 is a schematic side view of a first seat arrangement according to the invention in an upright basic position.

A first embodiment of a seat arrangement is first explained in greater detail with reference to FIGS. 1 to 9.

The seat arrangement comprises a base frame 1, a seat member 2 and a footrest 3. Optionally, a backrest 4 and an armrest 5 may further be provided.

Figure 2:
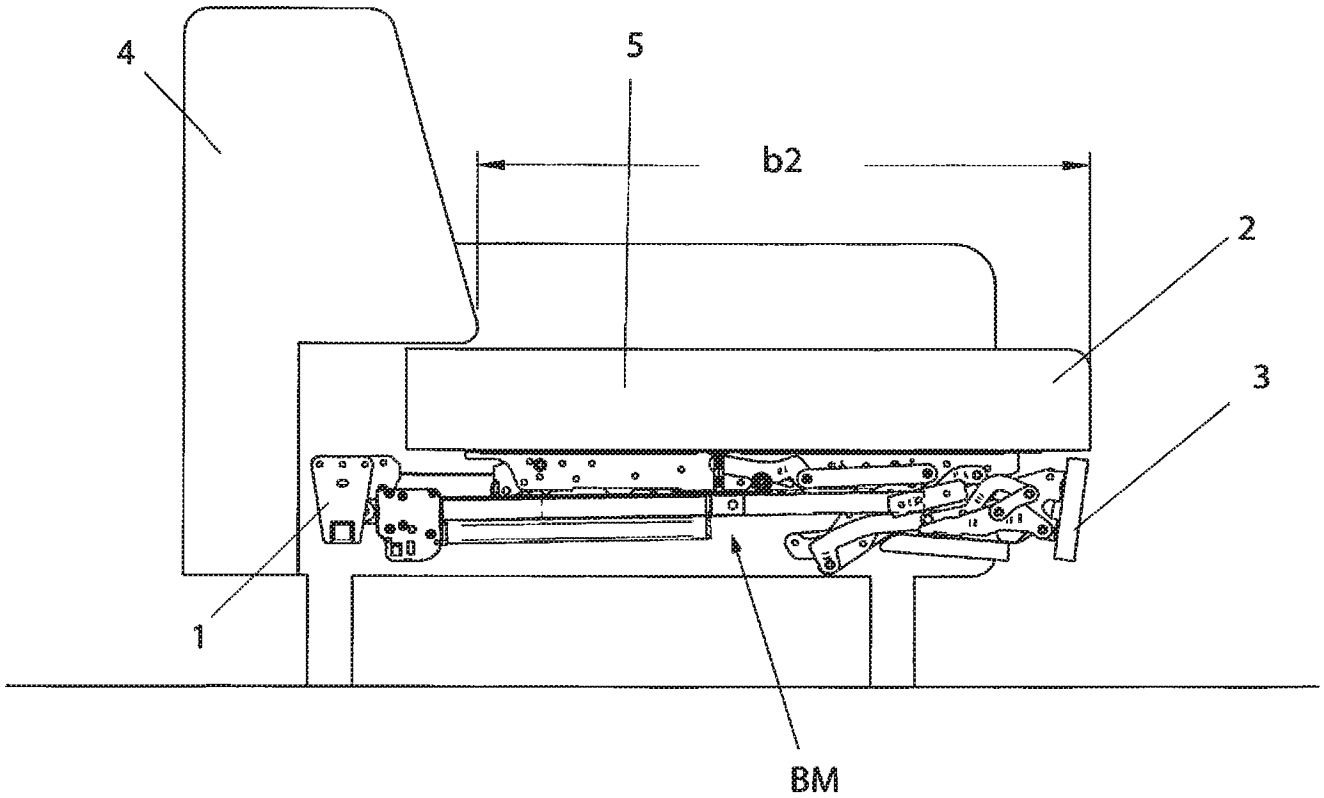
FIG. 2 is a schematic side view of the first seat arrangement according to the invention in a position with an increased seat depth.
Figure 3:
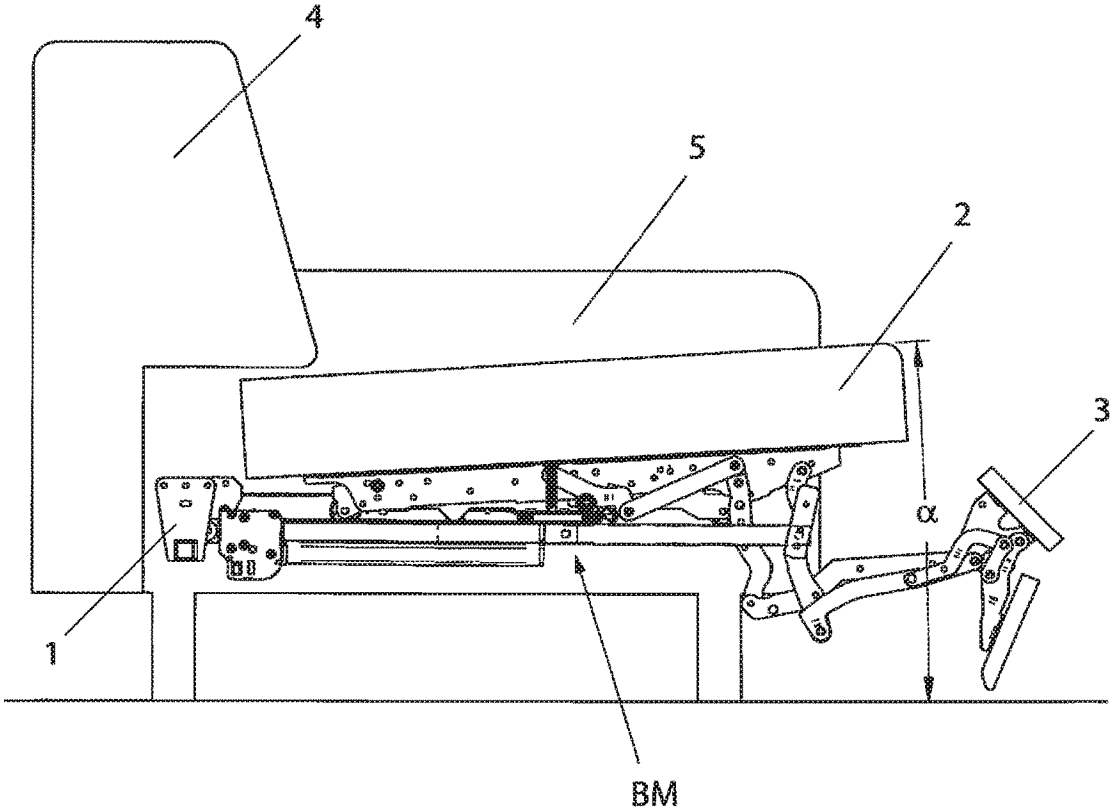
FIG. 3 is a schematic side view of the first seat arrangement according to the invention in a position with the footrest half-folded-out.
Figure 4:
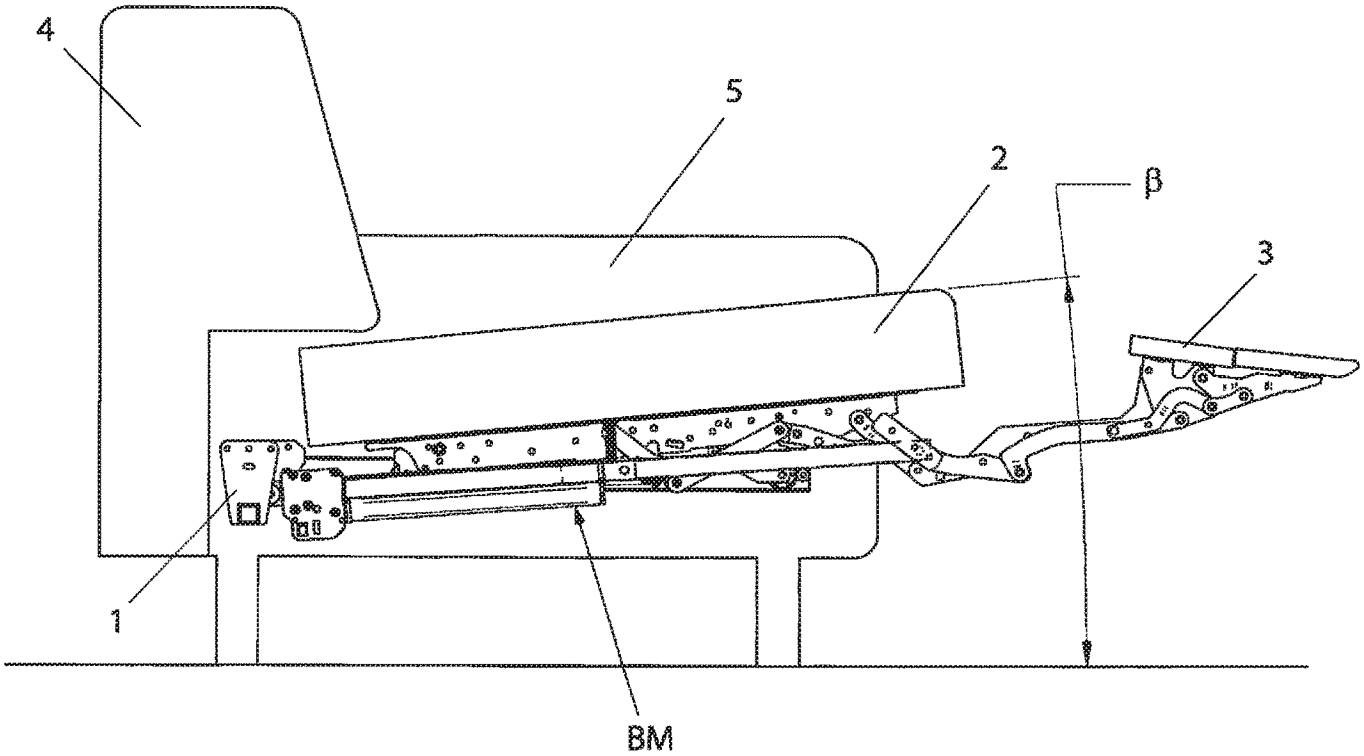
FIG. 4 is a schematic side view of the first seat arrangement according to the invention in a position with the footrest folded out.
Figure 5:
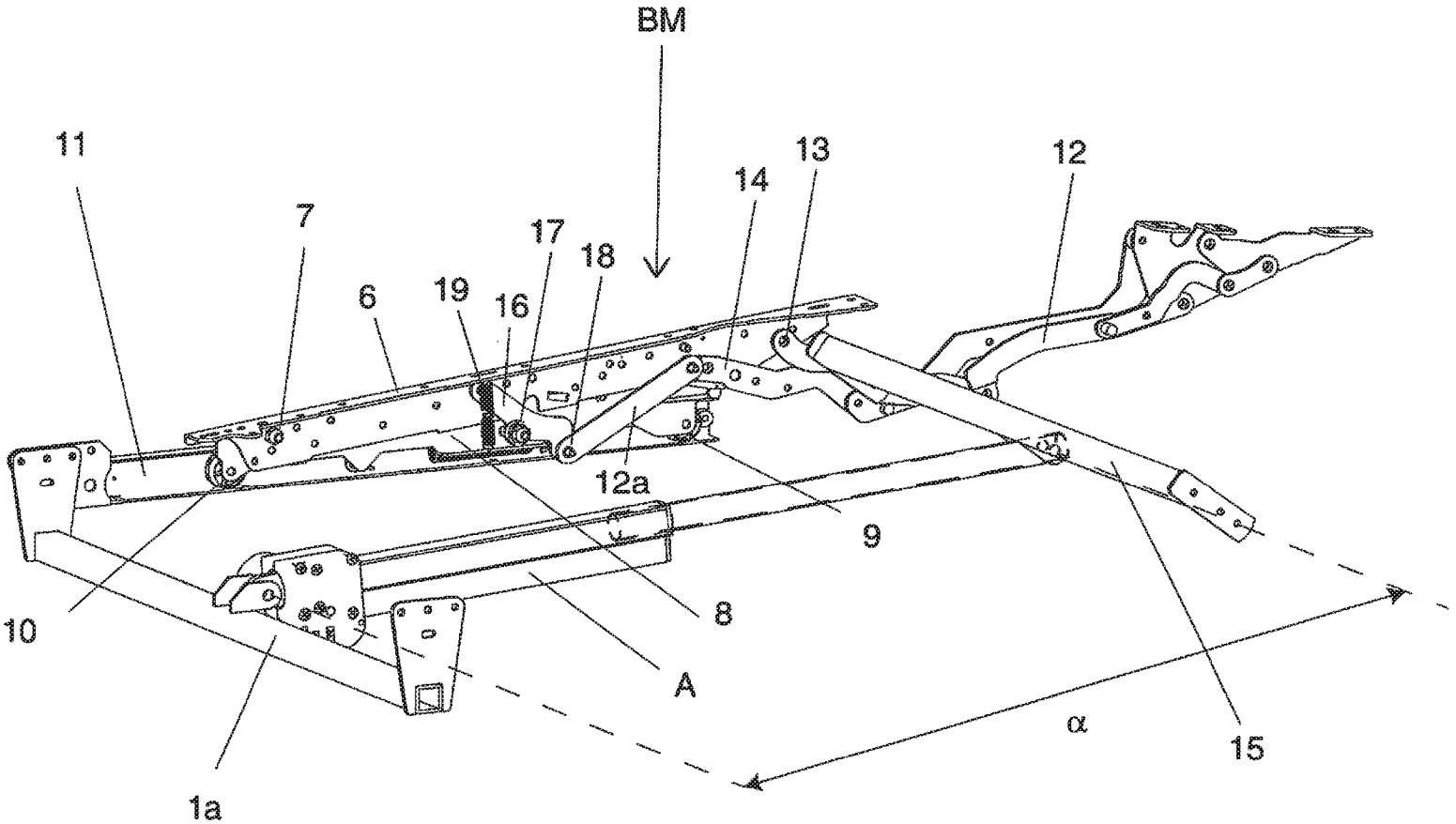
FIG. 5 is a three-dimensional illustration of the seat mechanism of the first seat arrangement according to the invention.

Furthermore, the seat arrangement comprises a seat mechanism which is constructed as a base module BM and which is shown in FIGS. 1 to 4 as different side views and in FIG. 5 as a three-dimensional illustration according to the position illustrated in FIG. 4. The base module BM is explained in greater detail below with reference to FIG. 5, wherein only the left half is illustrated. The seat member 2 has a seat frame 6 which is retained on a sliding member 8 so as to be able to be pivoted about a first articulation axis 7. The sliding member 8 is displaceably guided with a front roller 9 and a rear roller 10 in a guiding profile 11. The base module BM further comprises a rod mechanism 12 which is composed of a plurality of components and which is articulated with a third articulation 13 and a fourth articulation 14 in an articulated manner to the seat frame 6. The rod mechanism may in this instance be adjusted between a folded-in position according to FIG. 1 and a folded-out position according to FIG. 4.

FIG. 5 shows only the left side of the base module BM. The base module is also provided at the right-hand side so that the seat frame 6, the sliding member 8, the guiding profile 11 and the corresponding rod mechanism 12 of the footrest are each constructed in two parts and arranged in a mirror-symmetrical manner.

The base frame 1 has a first transverse rod 1*a* which connects both sides of the base module to each other. The guiding profile 11 of one side is thus secured to one end of the transverse rod 1*a* and the guiding profile of the other side is secured to the other end of the transverse rod 1*a*. The rod mechanisms 12 of the footrest 3 which are provided at both sides are also connected to each other by means of a second transverse rod 15. Between the first transverse rod 1*a* and the second transverse rod 15, there is provided a drive A which is constructed as a linear actuator and which is coupled with one end to the first transverse rod 1*a* of the base frame 1 and with the other end thereof to the second transverse rod 15 of the rod mechanism 12 of the footrest.

The base frame 1 and consequently also the first transverse rod 1*a* are arranged in a fixed or stationary manner in the seat arrangement. An actuation of the drive A in order to change the spacing a between the first transverse rod 1*a* and the second transverse rod 15 brings about a folding-out or folding-in of the footrest 3 using the rod mechanism 12.

However, the drive A serves not only to fold out the footrest 3 from the position shown in FIG. 2 via the intermediate position according to FIG. 3 into the folded-out position shown in FIG. 4, but instead also enables a displacement of the seat member from a first position of the sliding member (according to FIG. 1) in a second position of the sliding member (according to FIG. 2), wherein the seat member in the second position of the sliding member has a seat depth ($b2 \geq 1.1 * b1$) which is at least 10% greater than in the first position of the sliding member. Furthermore, as a result of the single drive A when folding out the footrest, a pivoting of the seat member about the first articulation axis 7 and consequently lifting of the front end of the seat member are brought about, as can be seen in FIGS. 3 (angle α) and 4 (angle β).

Figure 6:
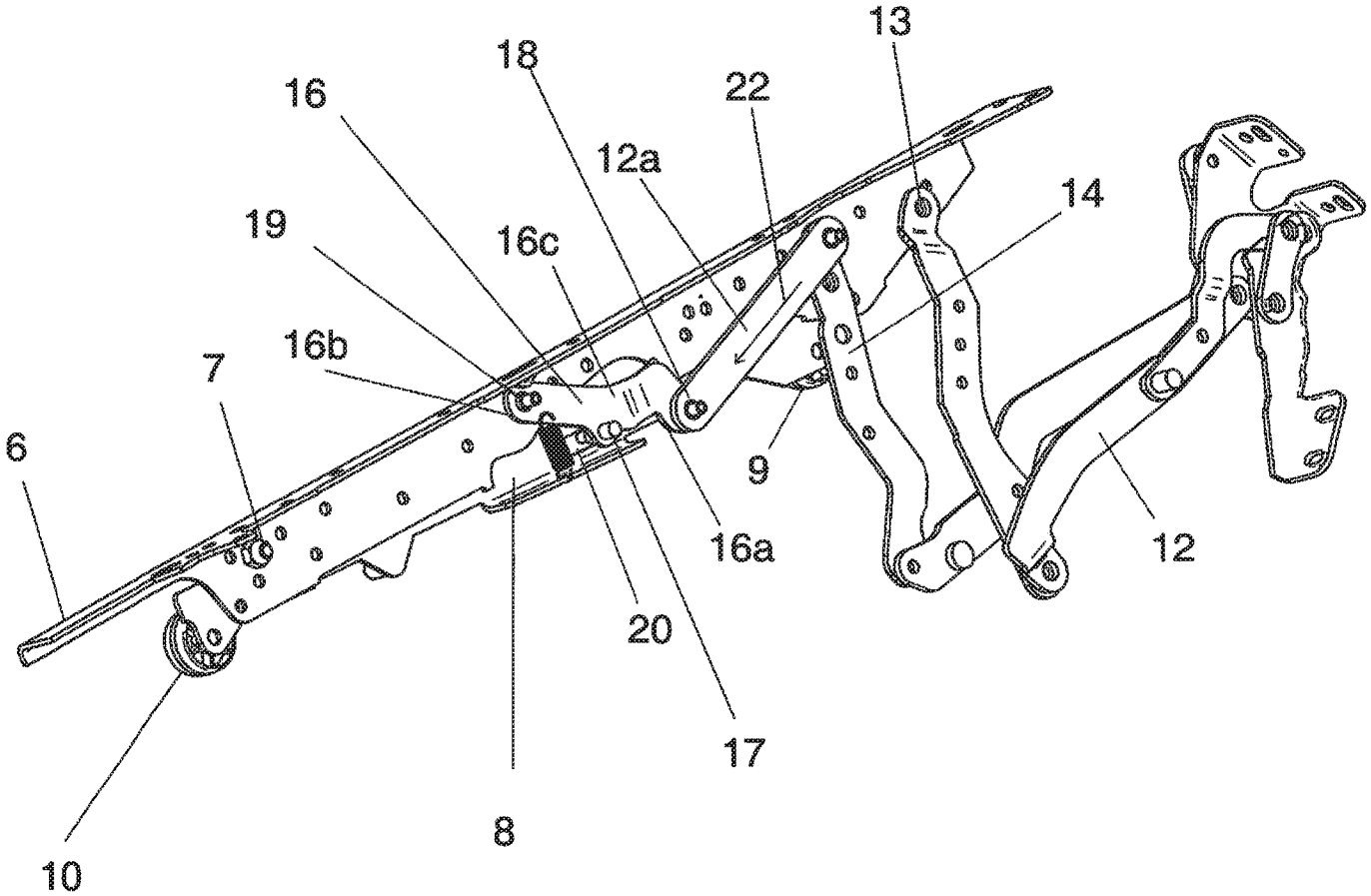
FIG. 6 is a three-dimensional illustration of a detail of the seat mechanism in the region of the dual-arm lever according to a first embodiment.
Figure 7:
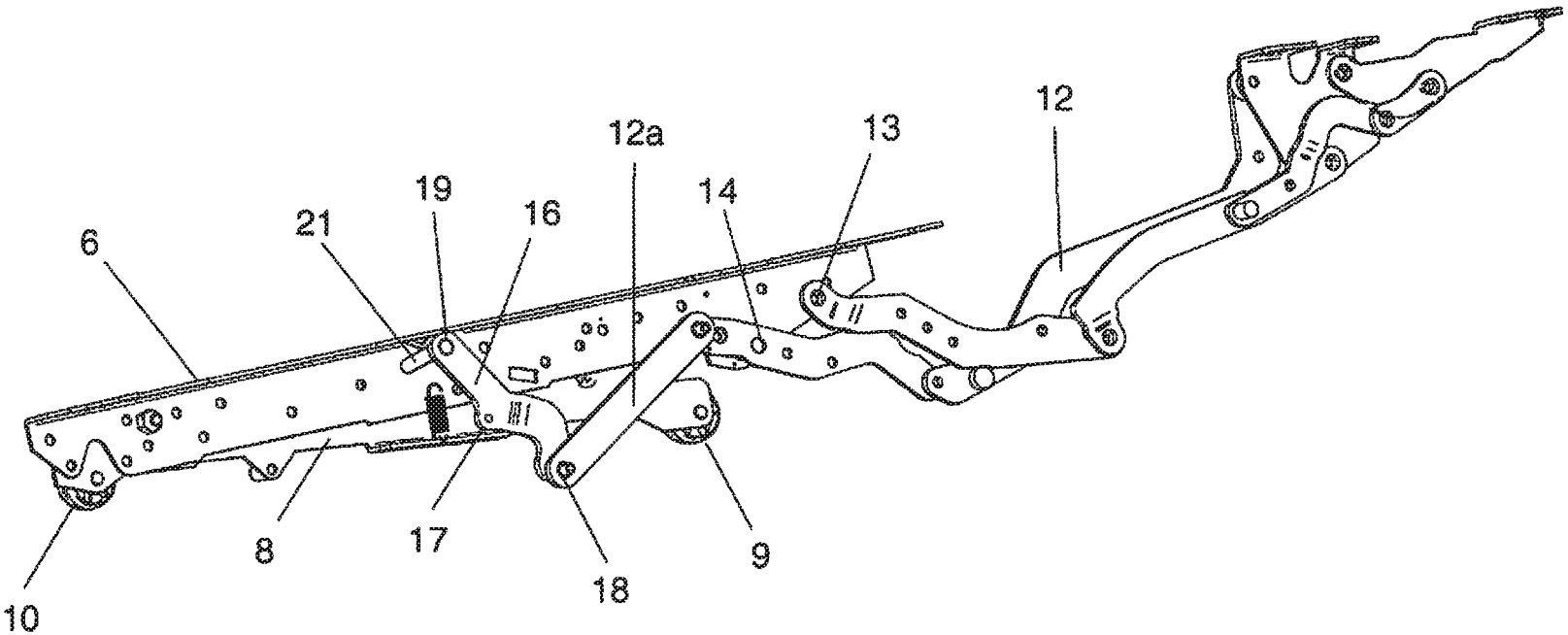
FIG. 7 is a three-dimensional illustration of a detail of the seat mechanism in the region of the dual-arm lever according to a second embodiment.

In order to be able to produce all these functions with a single drive, there is further provided a dual-arm lever arm 16 which has a first end 16*a*, a second end 16*b* and a central region 16*c* (FIG. 6).

The dual-arm lever arm 16 is rotatably supported on the sliding member in a central region 16*c* by means of a second articulation 17, whilst the first end 16*a* thereof is connected to the rod mechanism 12 of the footrest 3 and the second end 16*b* thereof to the seat frame 6 in such a manner that a movement of the footrest 3 between the folded-in and folded-out position brings about a pivot movement of the seat frame about the first articulation axis 7 between a basic position according to FIG. 1 and an inclined position according to FIG. 4.

The connection between the first end 16*a* and the rod mechanism 12 is carried out by means of a fifth articulation 18 and the connection between the second end 16*b* and the seat frame 6 by means of a sixth articulation 19. Since the seat frame 6 and the sliding member 8 are coupled to each other in an articulated manner by means of the first articulation axis 7, one of the coupling locations of the dual-arm lever arm 16 to the seat frame 6 or the sliding member 8 has to be constructed so as to be able to be displaced with respect to the associated component so that the pivot movement can be carried out about the first articulation axis 7. To this end, various embodiments are conceivable. Reference may be made to the variants shown in FIGS. 6, 7 and 8 purely by way of example.

In the first variant according to FIG. 6, the second articulation 17 in the central region 16*c* of the dual-arm lever arm 16 is displaceably guided in a slot 20 which is formed in the sliding member. Alternatively, in the second variant according to FIG. 7, a slot 21 is formed in the seat frame 6, whereby the sixth articulation 19 is displaceably guided therein.

Figure 8:
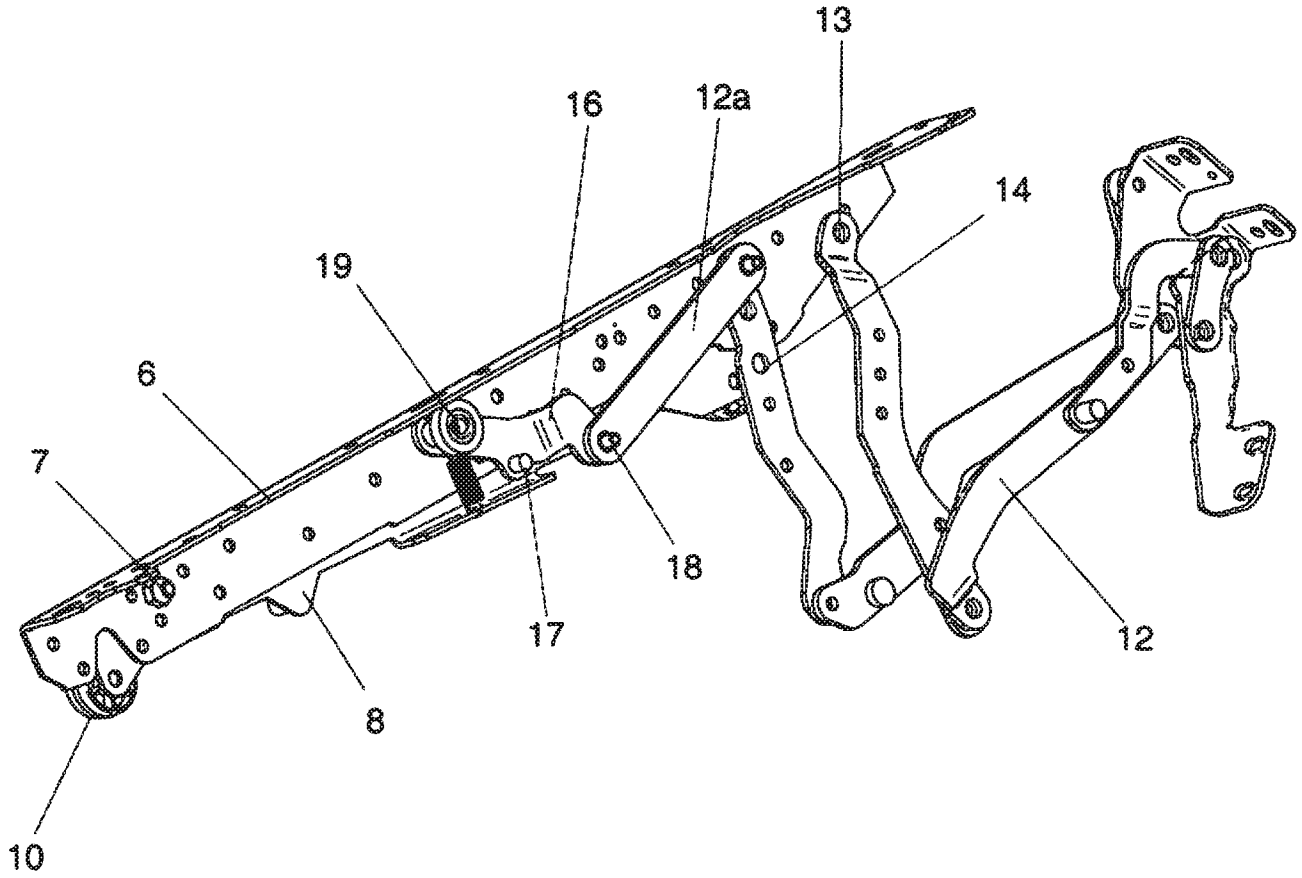
FIG. 8 is a three-dimensional illustration of a detail of the seat mechanism in the region of the dual-arm lever according to a third embodiment.
Figure 9:
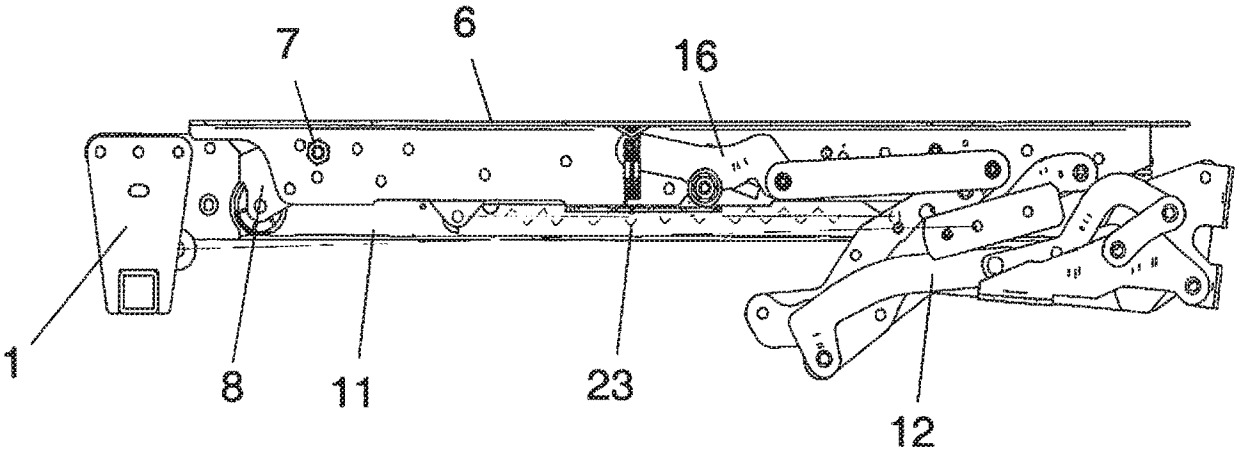
FIG. 9 is a side view of the seat mechanism in the position according to FIG. 1.

A third variant is illustrated in FIG. 8 in which the relative movement between the dual-arm lever arm 16 and the seat frame 6 is achieved by the sixth articulation 19 being produced as a bearing, in particular as a plain bearing or, as illustrated in this instance, as a roller bearing. When the drive A is actuated in order to fold out the footrest (see FIG. 6), a lever arm 12*a* of the rod mechanism 12 which is connected to the dual-arm lever arm 16 is moved in the direction of the arrow 22 and thereby brings about a rotation of the dual-arm lever arm about the second articulation 17 which in turn brings about a pivoting of the seat frame 6 about the first articulation axis 7. The embodiments according to FIGS. 7 and 8 function accordingly.

Figure 10:
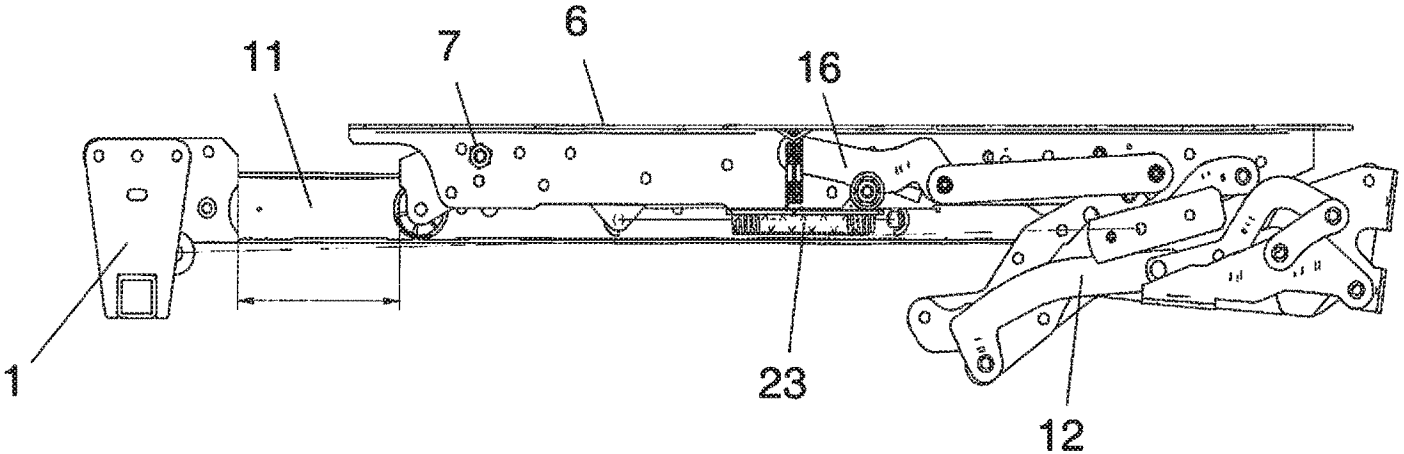
FIG. 10 is a side view of the seat mechanism in the position according to FIG. 2.
Figure 11:
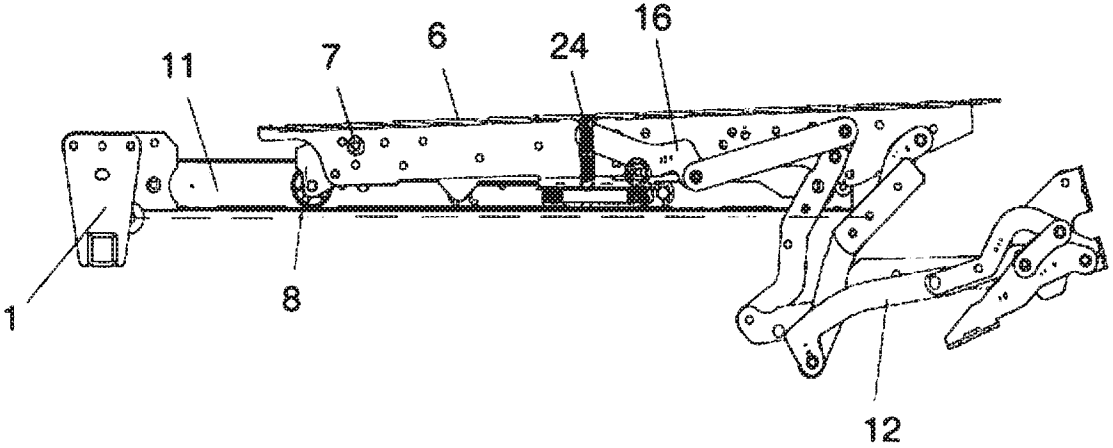
FIG. 11 is a side view of the seat mechanism in the position according to FIG. 3.
Figure 12:
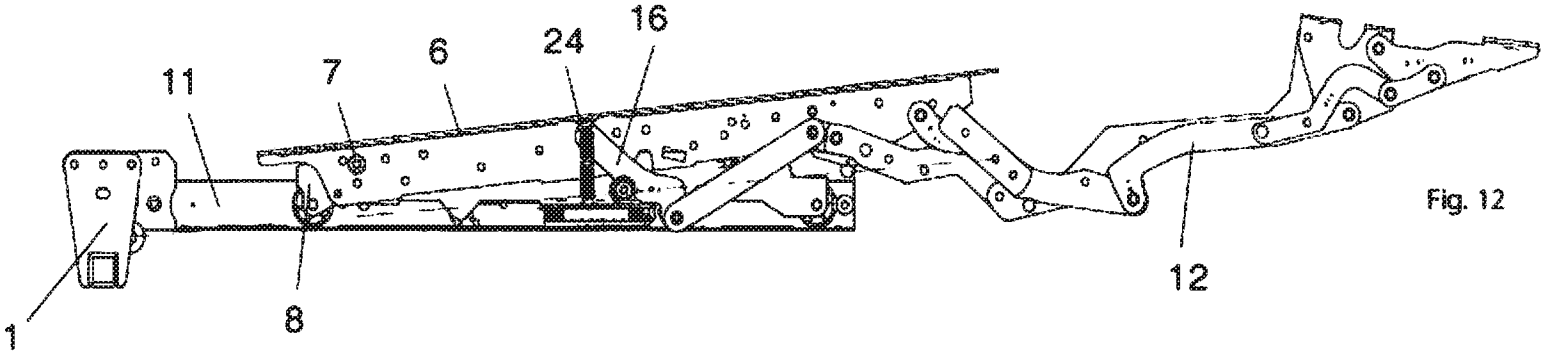
FIG. 12 is a side view of the seat mechanism in the position according to FIG. 4.

The base module makes provision for an adjustment of the seat depth to also be possible without folding out the footrest. In FIG. 1, the seat arrangement has a seat depth b1 and in FIG. 2 a seat depth b2, wherein b2 is at least 10%, preferably at least 15% greater than b1. However, since the drive extends between the base frame 1 and the second transverse rod 15 of the rod mechanism 12, according to FIG. 9 there is provided a first resilient element 23 which is arranged between the base frame 1 and the guiding profile 11 which is coupled thereto and the sliding member 6 in such a manner that the sliding member 6 is urged into the second position which is shown in FIG. 10 and in which the seat member has a greater seat depth (b2) than in the first position (b1). So that the sliding member can move into the first position shown in FIG. 9, the actuator must therefore be actuated in order to shorten the spacing between the first transverse rod 1*a* and the second transverse rod 15. In order to displace the sliding member 6 without folding out the footrests, the actuator only has to be activated in order to increase the spacing a. As a result of the resilient element 23, the sliding member is then automatically moved into the second position shown in FIG. 10. Only when the drive A is further actuated in order to increase the spacing a is the footrest folded out, as shown in FIGS. 11 and 12. However, the folding-out of the footrest also brings about via the dual-arm lever arm 16 at the same time a pivot movement of the seat frame about the first articulation axis 7.

There is further provided between the sliding member 8 and the seat frame 6 at least a second resilient element 24 which urges the seat frame 6 into the position according to FIG. 11.

A second embodiment of the seat arrangement is described below with reference to FIGS. 13 to 21 and in addition to the above-described base module BM further also has a backrest inclination module RM for adjusting the inclination of the backrest 4. A zero space module ZM is further optionally provided. FIG. 17 is an exploded view from which the connections of the individual modules with each other and with the base frame are derived. The base module BM substantially comprises the guiding profile 11, the sliding member 8, the seat frame 6 and the rod mechanism 12. The backrest inclination module comprises a coupling rod assembly 25 which is secured with a portion 25*a* to the base module BM and with another portion 25*b* to the base frame 1. The zero space module ZM has an actuation rod assembly 26 which is secured with a portion 26*a* to the base frame 1 and with another portion 26*b* to the base module BM.

Figure 18:
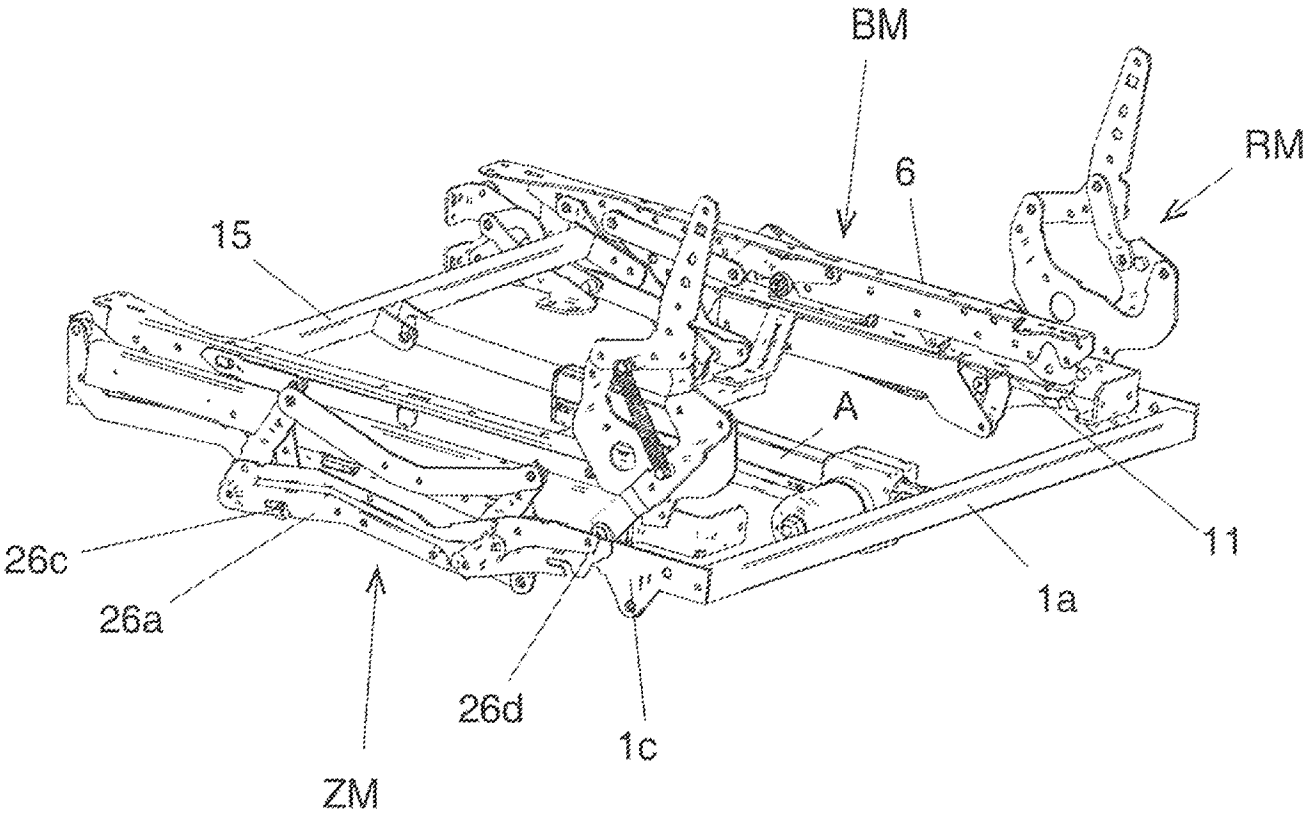
FIG. 18 is a three-dimensional illustration of the seat mechanism of the second seat arrangement according to the invention in the position according to FIG. 9.
Figure 19:
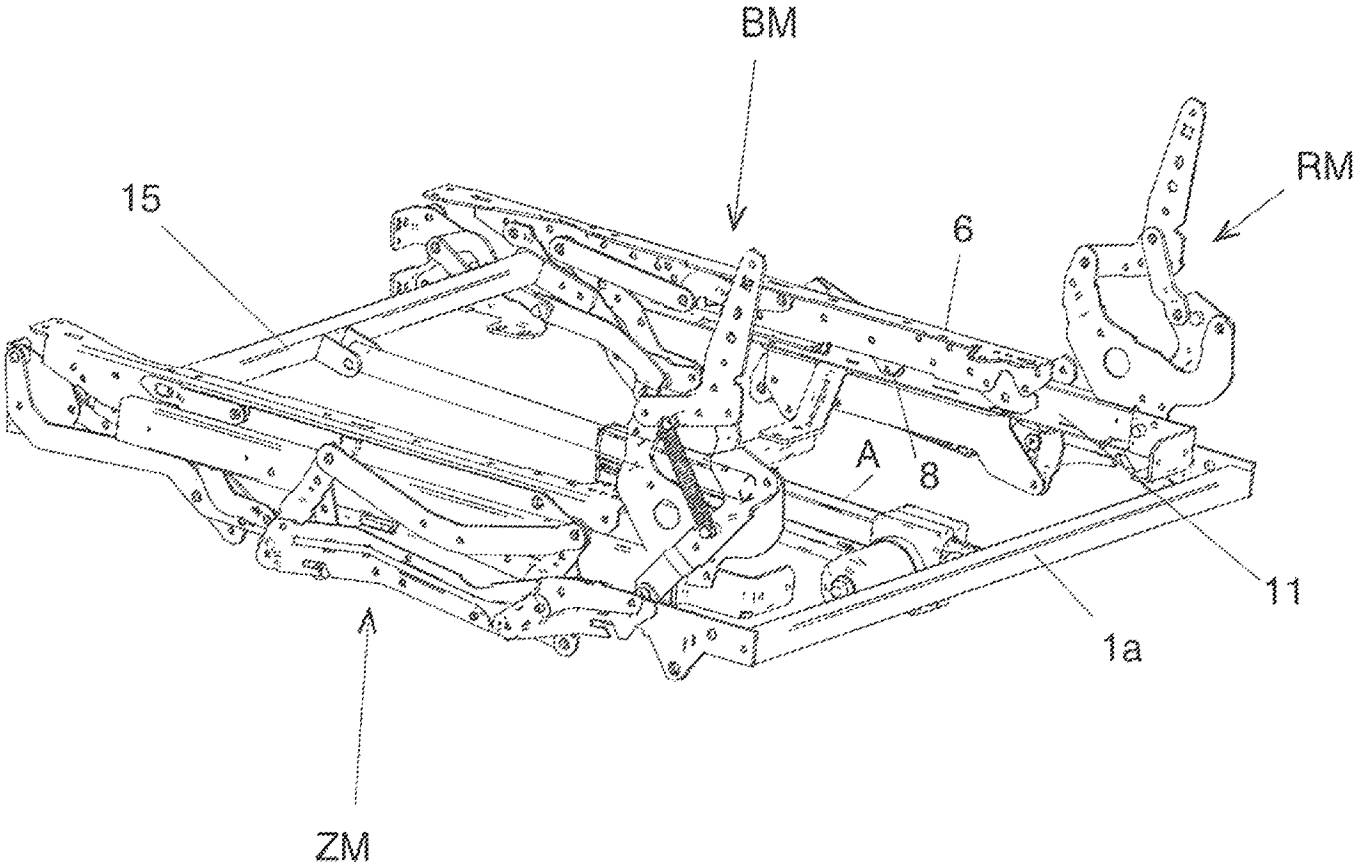
FIG. 19 is a three-dimensional illustration of the seat mechanism of the second seat arrangement according to the invention in the position according to FIG. 10.
Figure 20:
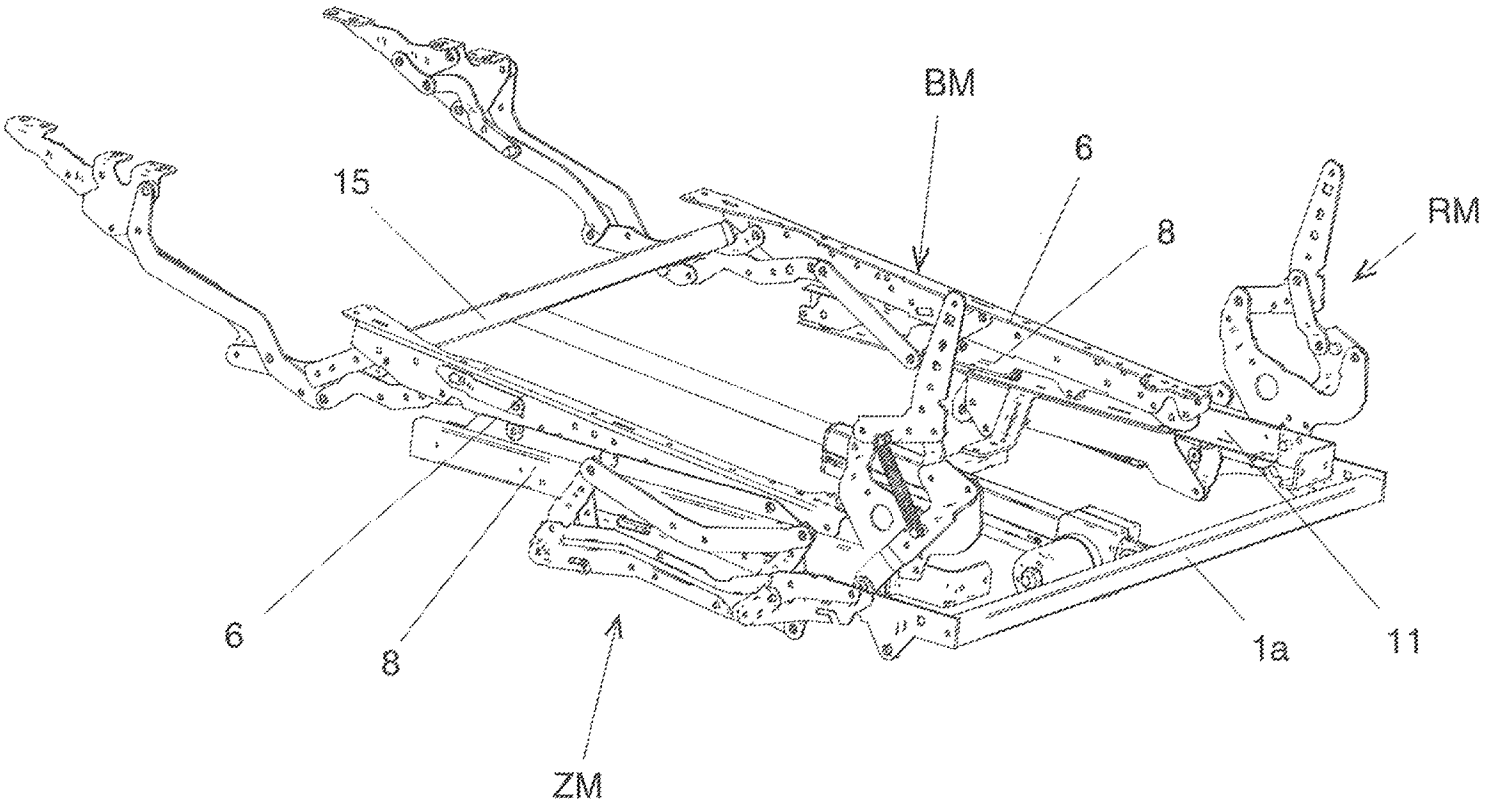
FIG. 20 is a three-dimensional illustration of the seat mechanism of the second seat arrangement according to the invention in the position according to FIG. 11.
Figure 21:
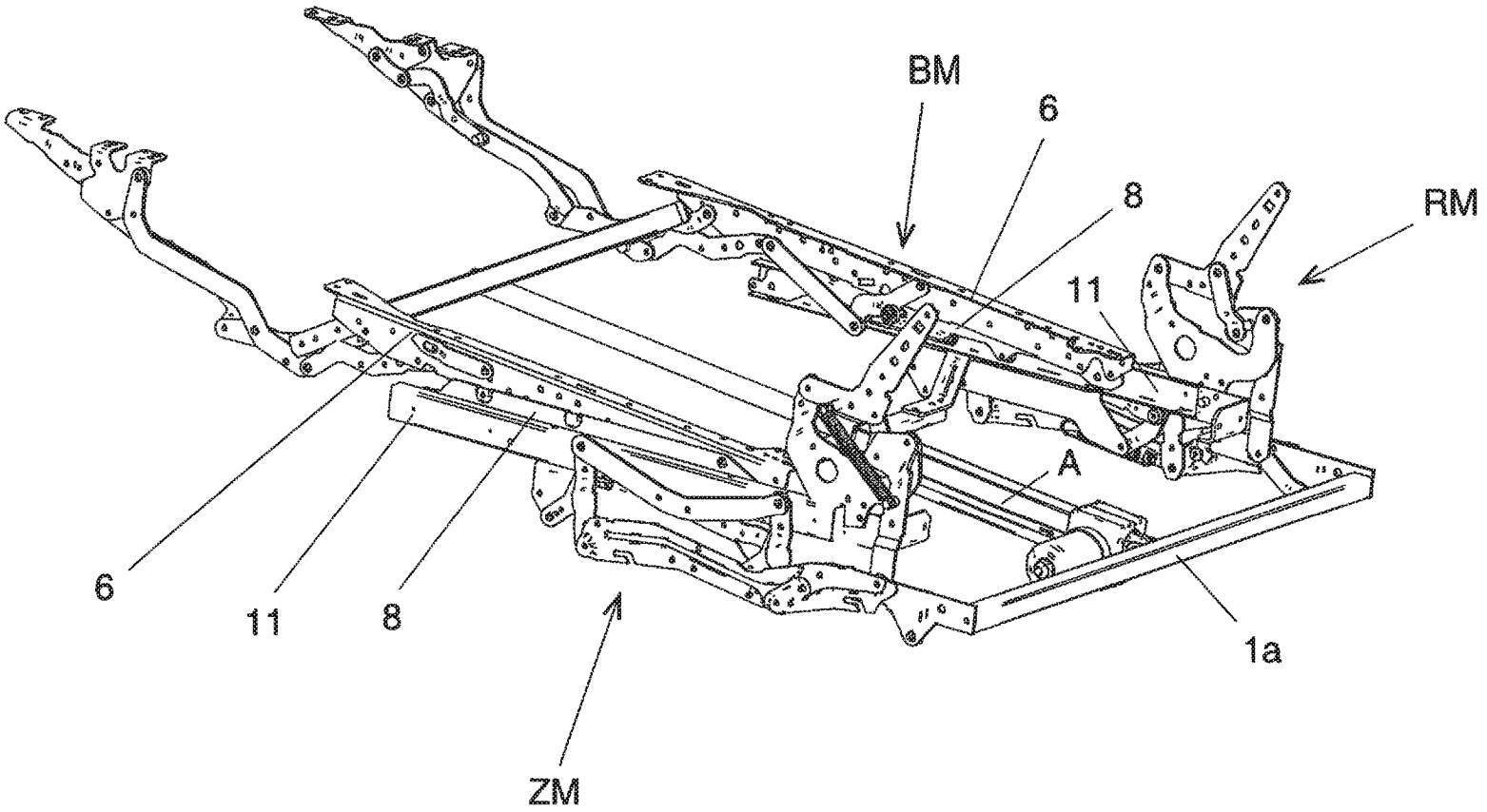
FIG. 21 is a three-dimensional illustration of the seat mechanism of the second seat arrangement according to the invention in the position according to FIG. 12.

In addition to the additional backrest inclination module RM and the additional zero space module ZM, there is further also the additional difference with respect to the first embodiment that the base module BM is not secured in a fixed manner to the base frame 1 with the guiding profile 11 thereof, but instead, in the same manner as the zero space module ZM and the backrest inclination module RM, is coupled to the base frame 1 in an articulated manner. The portion 26*a* of the zero space module ZM has slots 26*c* and 26*d*, wherein the slots serve to secure to the base frame 1 or another fixed component, such as, for example, an armrest carrier (FIG. 18).

Figure 13:
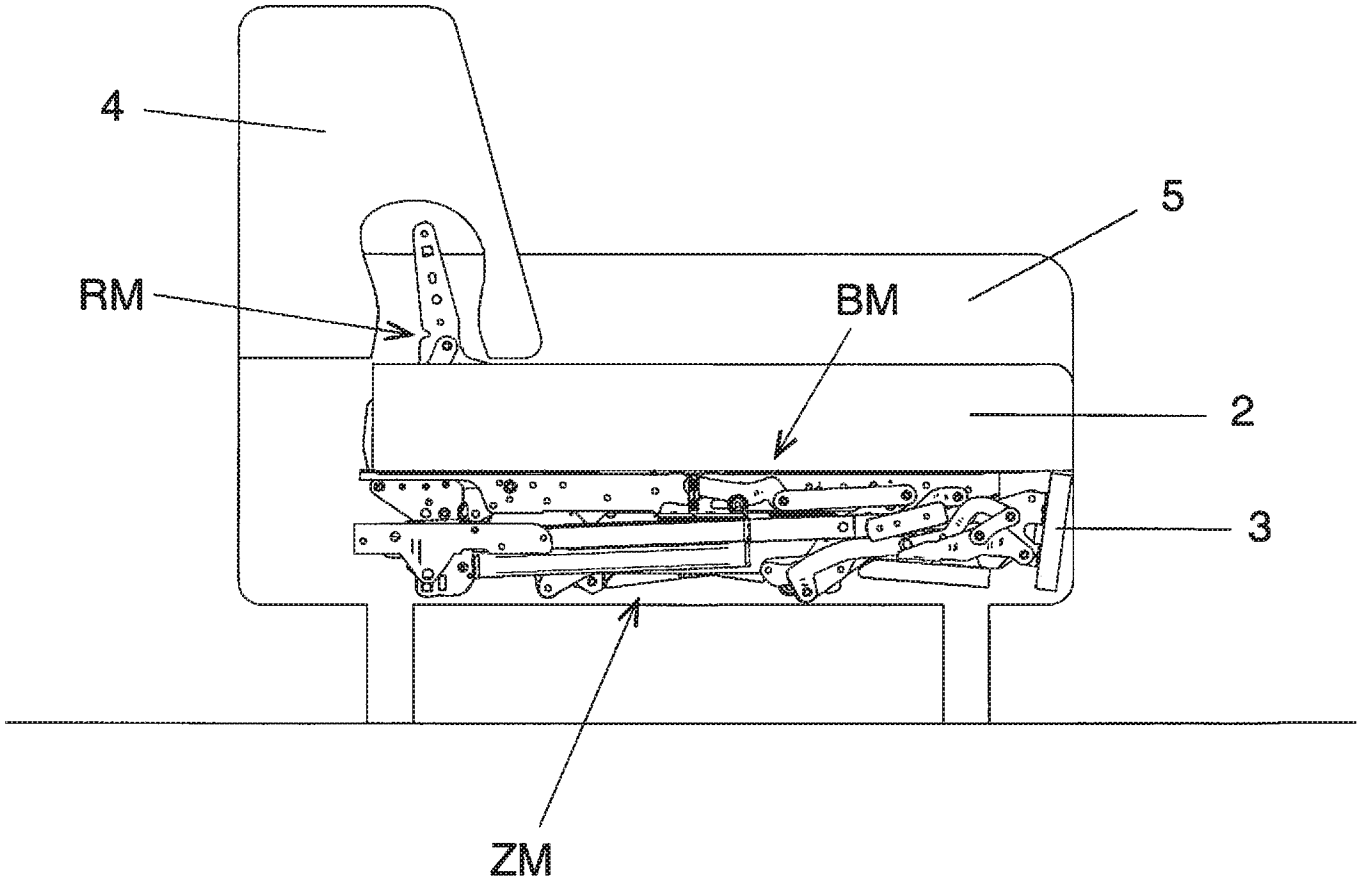
FIG. 13 is a schematic side view of a second seat arrangement according to the invention in an upright basic position.
Figure 14:
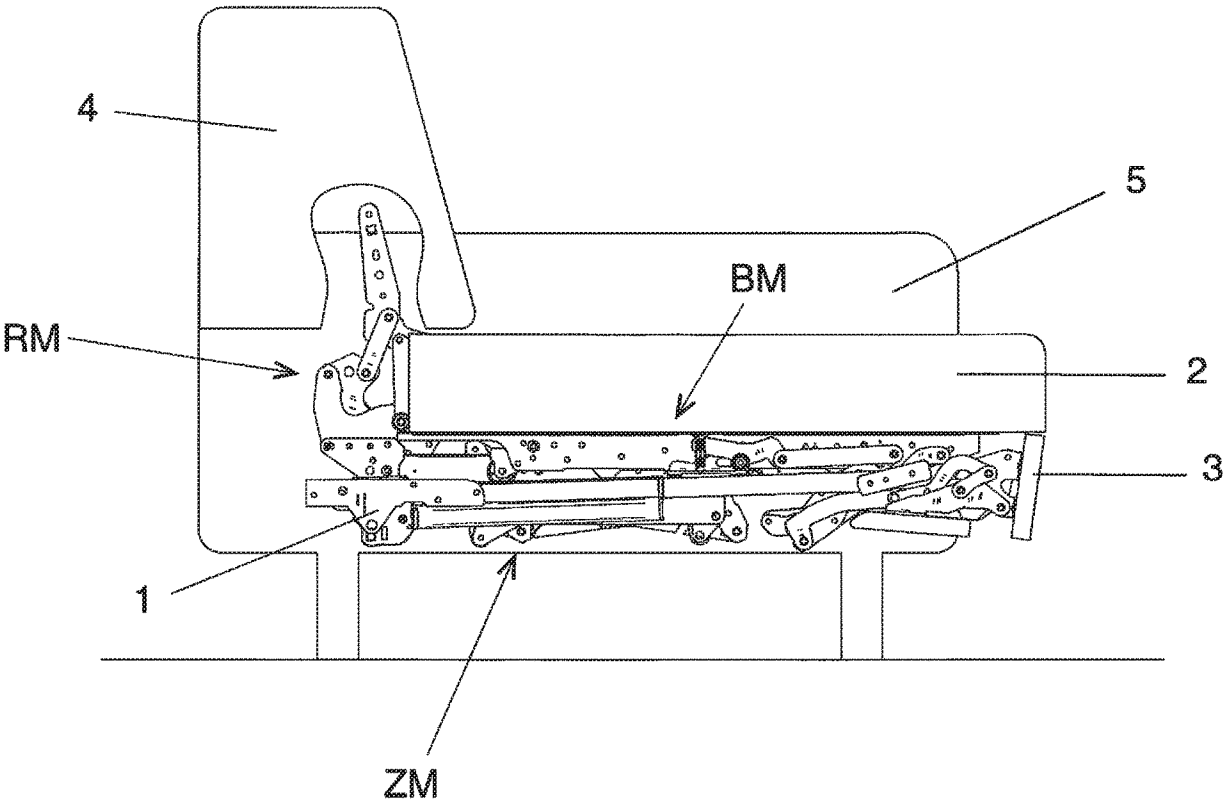
FIG. 14 is a schematic side view of the second seat arrangement according to the invention in a position with an increased seat depth.
Figure 15:
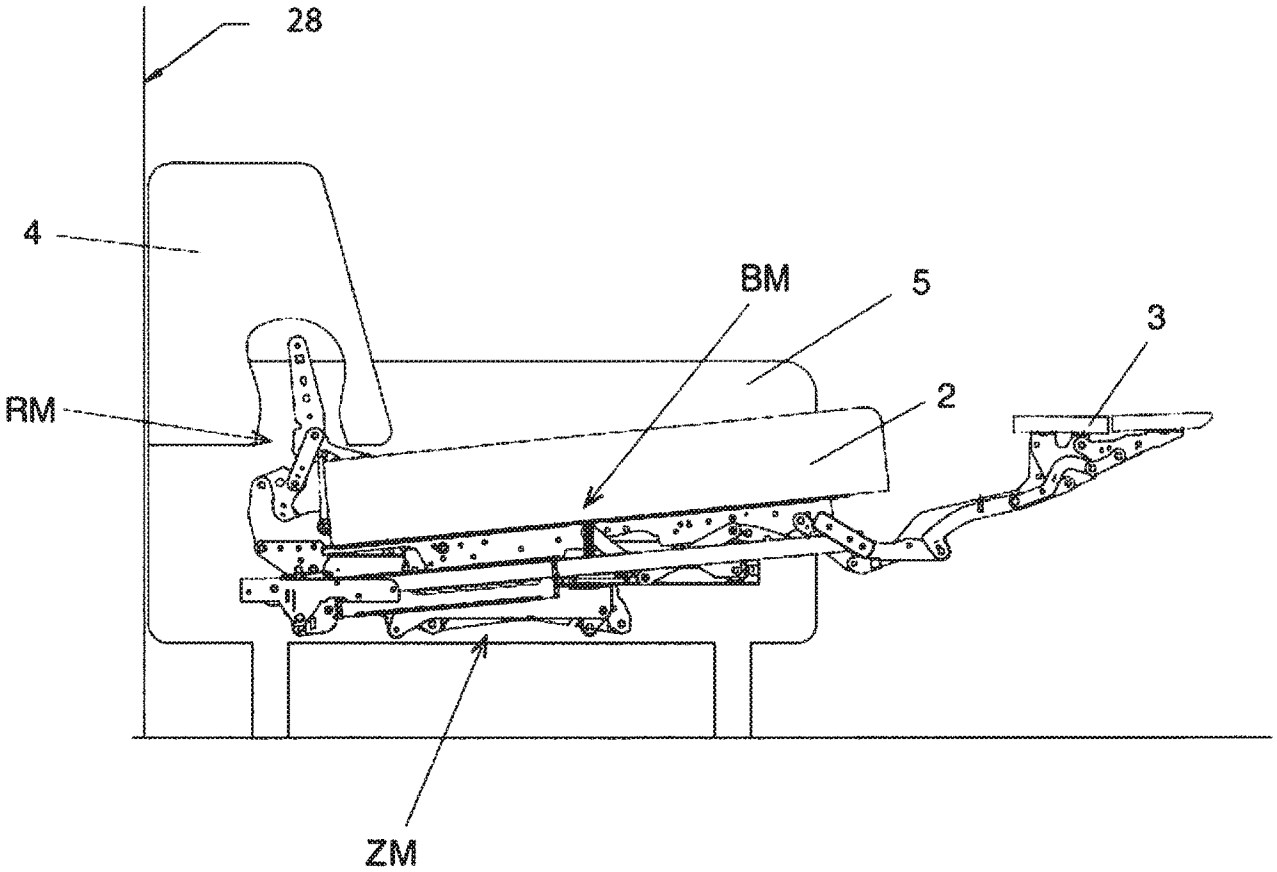
FIG. 15 is a schematic side view of the second seat arrangement according to the invention in a position with a folded-out footrest.
Figure 16:
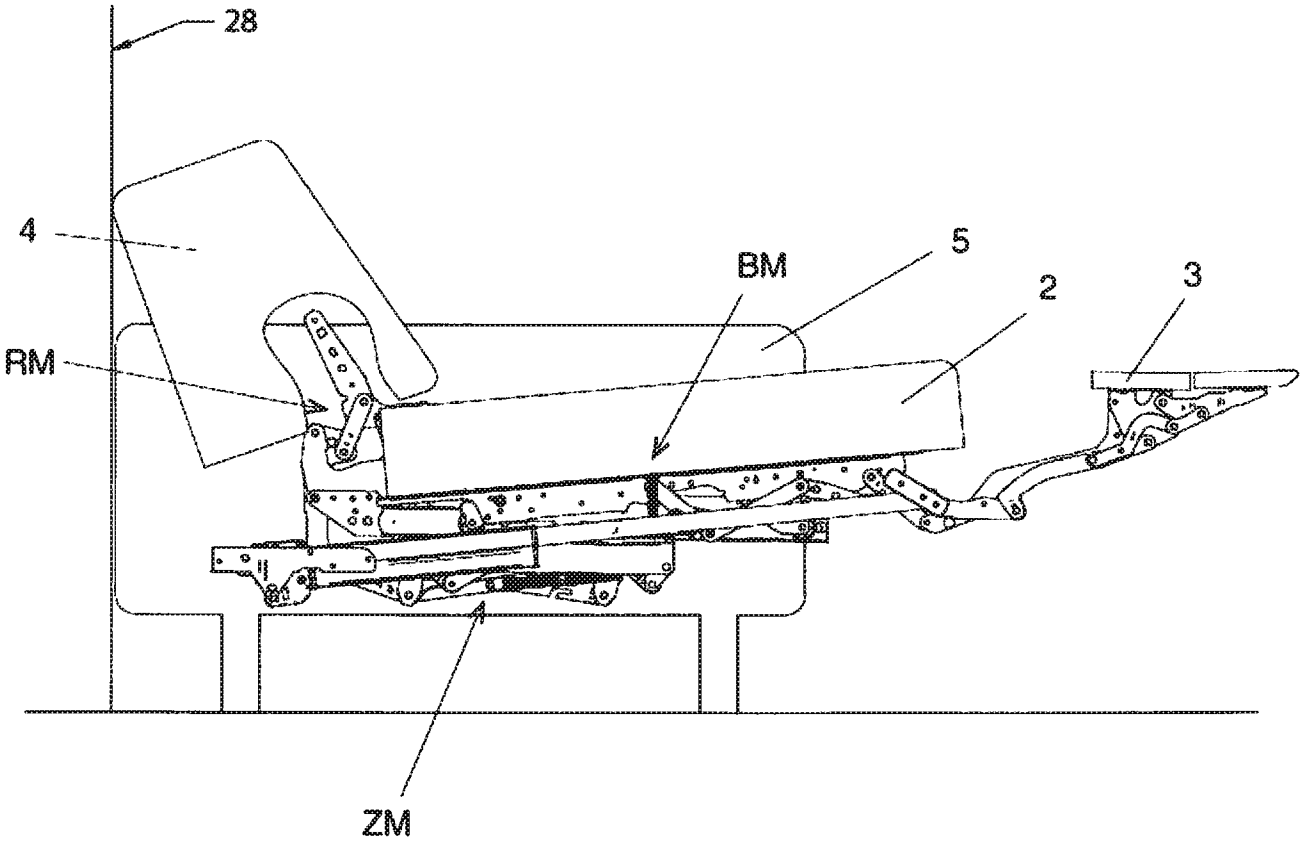
FIG. 16 is a schematic side view of the second seat arrangement according to the invention in a position with an additionally inclined backrest.
Figure 17:
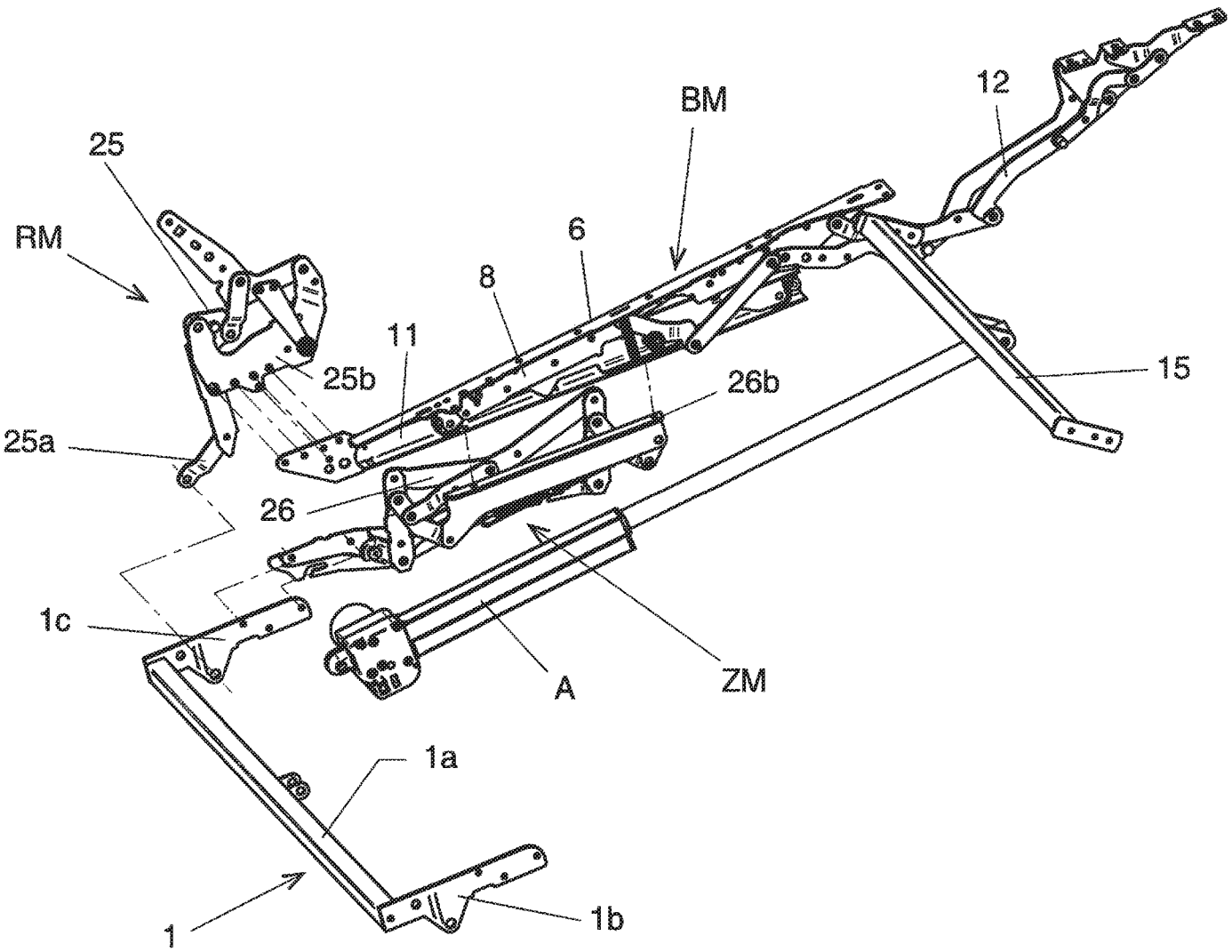
FIG. 17 is a three-dimensional illustration of the seat mechanism of the second seat arrangement according to the invention.

In order to move from the upright basic position according to FIG. 13 into the horizontal or reclined position according to FIG. 16, the seat depth is initially brought about by displacing the sliding member 8 along the guiding profile 11. The increased seat depth is produced from FIG. 14 or from the position of the seat mechanism according to FIG. 19 in comparison with FIG. 13 or FIG. 18. A further actuation of the drive A leads to folding out of the footrest 3 and an inclination of the seat frame 6 in accordance with the movement sequence, as already described in the first embodiment. The position which is then produced can be seen in FIGS. 15 and 20. Until then, there has been no movement of the backrest 4. If the drive A is further actuated in order to increase the spacing between the first transverse rod 1*a* and the second transverse rod 15, as a result of the zero space module ZM there is produced a displacement of the entire base module BM and consequently also an actuation of the backrest inclination module since it is secured to the base module BM on the one hand and to the fixed base frame 1 on the other hand. Consequently, the seat member 2 is again displaced further forwards and the backrest can be inclined backwards without a significant change of the spacing with respect to a rear wall 28 being produced. The seat arrangement can consequently also be placed in the upright position in the immediate vicinity of the wall 28 and can nonetheless be moved into the horizontal or reclined position shown in FIGS. 16 and 21.

The entire seat mechanism can be produced in an extremely compact form, the entire structural height of the seat mechanism including the folded-in footrest thus comprises no more than 20 cm, preferably no more than 18 cm and extremely preferably no more than 15 cm. This compact construction form enables the seat mechanism to be accommodated in a relatively unobtrusive manner so that there can be provided an aesthetically pleasing seat arrangement which nonetheless allows the comfort of a very variable adjustability between an upright position and a horizontal or reclined position.

The invention claimed is:

1. A seat arrangement having a base frame, a seat member and a footrest, wherein the seat member has a seat frame which is retained on a sliding member so as to be able to be pivoted about a first articulation axis, wherein the sliding member is displaceably guided between a first and a second position in a guiding profile, and wherein the footrest is articulated to the seat frame by means of a rod mechanism and can be adjusted between a folded-in position and a folded-out position, further comprising a drive for displacing the sliding member and for folding the footrest in and out is provided between the base frame and the rod mechanism of the footrest and there is provided a dual-arm lever arm having a first end, a second end and a central region, wherein the dual-arm lever arm is rotatably supported on the sliding member in the central region thereof and is connected with the first end thereof to the rod mechanism of the footrest and with the second end thereof to the seat frame in such a manner that a movement of the footrest between the folded-in and folded-out position brings about a pivot movement of the seat frame about the first articulation axis between a basic position and an inclined position.

2. The seat arrangement according to claim 1, wherein the dual-arm lever arm is rotatably supported on the sliding member by means of a second articulation, wherein the second articulation is guided in a slot which is formed in the sliding member.

3. The seat arrangement according to claim 1, wherein the connection of the dual-arm lever arm to the seat frame is carried out by means of a bearing, in particular a plain bearing or a roller bearing.

4. The seat arrangement according to claim 1, wherein the connection of the dual-arm lever arm to the seat frame is also produced by means of a second articulation which is guided in a slot formed in the seat frame.

5. The seat arrangement according to claim 1, wherein the first articulation axis is arranged at a rear end of the seat frame and the rod mechanism of the footrest is coupled to a front end of the seat frame.

6. The seat arrangement according to claim 1, wherein between the base frame and the sliding member there is provided at least a first resilient element which urges the sliding member into the second position in which the seat member has a greater seat depth than in the first position.

7. The seat arrangement according to claim 1, wherein between the sliding member and the seat frame there is provided at least a second resilient element which urges the seat frame into the basic position.

8. The seat arrangement according to claim 1, wherein the base frame has a first transverse rod and the drive is formed by a linear actuator which is coupled with one end to the first transverse rod and with the other end thereof to a second transverse rod of the rod mechanism of the footrest.

9. The seat arrangement according to claim 1, wherein the seat member in the second position of the sliding member has a seat depth which is at least 10% greater than in the first position of the sliding member.

10. The seat arrangement according to claim 1, wherein the seat frame is pivoted between the basic position and the inclined position through at least 5° C. about the first articulation axis.

11. The seat arrangement according to claim 1, wherein the seat arrangement further has a base module which comprises the guiding profile, the sliding member, the seat frame and the rod mechanism and is displaceably guided in the base frame.

12. The seat arrangement according to claim 1, wherein the seat arrangement further comprises a backrest and a backrest inclination module for adjusting the inclination of the backrest.

13. The seat arrangement according to claim 11, wherein the backrest inclination module comprises a coupling rod assembly which is secured with one portion to the base module and with another portion to the base frame.

14. The seat arrangement according to claim 13, wherein there is further provided a zero space module which has an actuation rod assembly which is secured with one portion to the base frame and with another portion to the base module.

* * * * *